US007344485B1

(12) United States Patent
Simpson et al.

(10) Patent No.: US 7,344,485 B1
(45) Date of Patent: Mar. 18, 2008

(54) SPORTS TRAINING AND EXERCISE DEVICE

(76) Inventors: Ralph Simpson, 615 Kaeding Creek Rd., Whitefish, MT (US) 59937; Pete Draovitch, 503 Culloden Ct., Greensburg, PA (US) 15601; Steve McGee, 816 Ladera Dr., Fort Worth, TX (US) 76108

( * ) Notice: Subject to any disclaimer, the term of this patent is extended or adjusted under 35 U.S.C. 154(b) by 419 days.

(21) Appl. No.: 10/628,081

(22) Filed: Jul. 25, 2003

Related U.S. Application Data

(60) Provisional application No. 60/399,109, filed on Jul. 26, 2002.

(51) Int. Cl.
*A63B 21/00* (2006.01)

(52) U.S. Cl. ..... 482/126; 482/121

(58) Field of Classification Search ..... 482/121–130, 482/140, 141
See application file for complete search history.

(56) References Cited

U.S. PATENT DOCUMENTS 4,441,707 A * 4/1984 Bosch ..... 482/131
4,540,173 A * 9/1985 Hopkins, Jr. ..... 482/124
4,909,505 A 3/1990 Tee
5,186,698 A 2/1993 Mason et al.
5,263,916 A 11/1993 Bobich
5,336,151 A 8/1994 Van Ballegooie
5,362,295 A * 11/1994 Nurge ..... 482/124
5,653,668 A 8/1997 Wilkinson
5,681,248 A * 10/1997 Vani ..... 482/126
5,813,954 A * 9/1998 Wilkinson ..... 482/124
5,916,070 A * 6/1999 Donohue ..... 482/74
6,022,302 A * 2/2000 McBride ..... 482/121
6,036,625 A 3/2000 Woodruff
6,244,998 B1 * 6/2001 Hinds ..... 482/126
6,293,893 B1 9/2001 Truchelut
6,402,668 B1 6/2002 Harker
6,450,929 B1 9/2002 Markham
6,497,641 B1 12/2002 Hinds

* cited by examiner

*Primary Examiner*—Jerome Donnelly
(74) *Attorney, Agent, or Firm*—Richard C. Conover

(57) ABSTRACT

A resistance exercise device including a length of resilient tubing having first and second free ends. Strap handles are connected to the free ends of the tubing. The resilient tubing is threaded through at least one oversized tubular section, constructed of rubberized foam, which section provides padding at pressure points when the resilient tubing is positioned across or around a user while exercising. A support strap is connected to the first tubular section. In a second embodiment, an exercise belt can be used with the present invention. The belt includes a buckle for buckling the free ends of the belt together and a "D"-ring mounted to one side of the belt. A karabiner is used to connect a strap handle to a "D"-ring.

2 Claims, 4 Drawing Sheets

SPORTS TRAINING AND EXERCISE DEVICE

SPECIFICATION

This application claims the benefit of provisional application Ser. No. 60/399,109, filed Jul. 26, 2002.

BACKGROUND OF THE INVENTION

The present invention relates to a sports training and exercise device used for resistance exercise of an individual's muscle structure.

Elastomeric exercise apparatus are known for use by individuals in exercising and strengthening muscles. For example, see U.S. Pat. No. 4,909,505 to Tee.

The present invention is an improvement over the known elastomeric exercise device because it provides a device providing more versatility than devices previously known. Further, it provides an exercise device having portions for padding the exercise device against a user using the device.

SUMMARY OF INVENTION

The present invention provides a versatile exercise device providing a resistance-type exercise apparatus adaptable for a variety of body exercises. The present invention includes a length of resilient tubing having first and second free ends. Strap handles are connected to the free ends of the tubing. The resilient tubing is threaded through at least one oversized tubular section, constructed of rubberized foam, which section provides padding at pressure points when the resilient tubing is positioned across or around a user while exercising. A support strap is connected to the first tubular section.

The present invention can be used in several ways. One of the strap handles can be secured to a hook on a wall and an exercise commenced. Also, the support strap can be secured to a hook on a wall, for example, and the handles grasped by a user to exercise against the resilient force provided by the resilient tubing.

In a second embodiment, an exercise belt can be used with the present invention. The belt includes a buckle for buckling the free ends of the belt together and a "D"-ring mounted to one side of the belt. A karabiner is used to connect a strap handle to a "D"-ring. The free handle can then be secured to a wall hook or to a door by closing the door on the handle strap thereby providing a point of attachment against which a user performs resistance exercises.

Various other loops can be formed by threading the strap handles through the support loop.

With the present invention, a portable, lightweight resistance-type exercise device is provided which enables a user to conduct a variety of exercises for the upper body, the abdomen and the legs.

DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
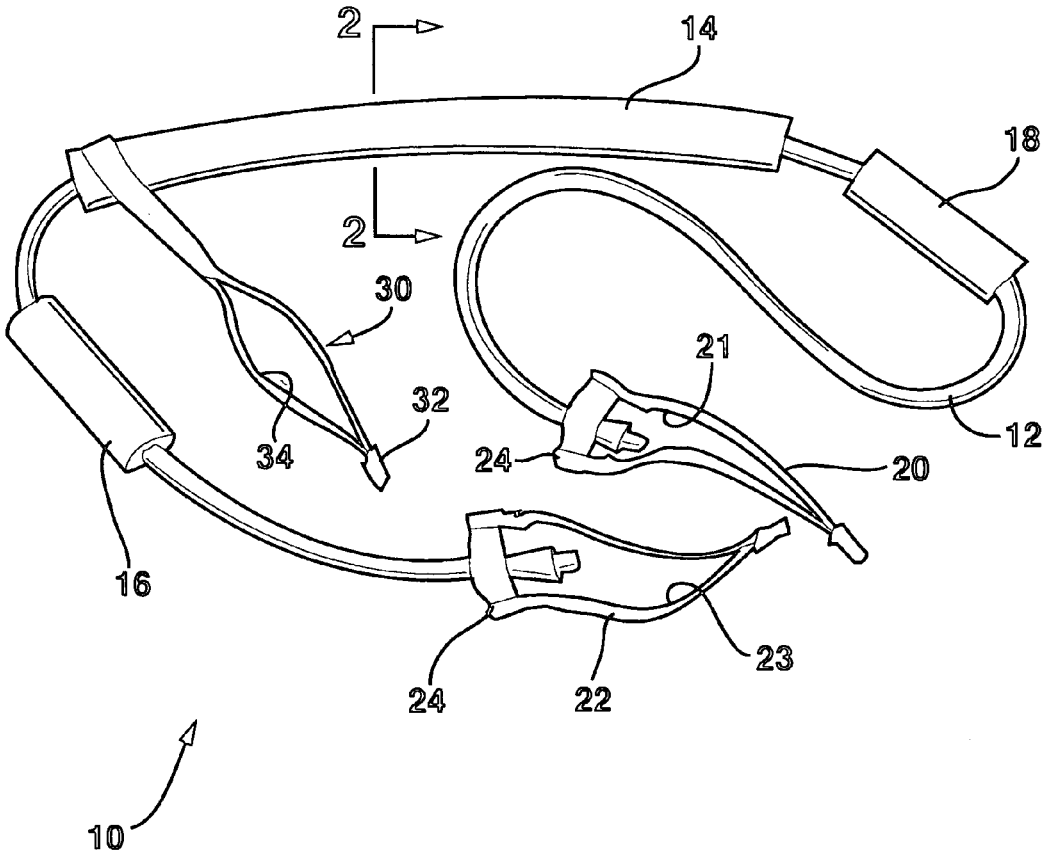
FIG. 1 is a perspective view of the present invention.
Figure 2:
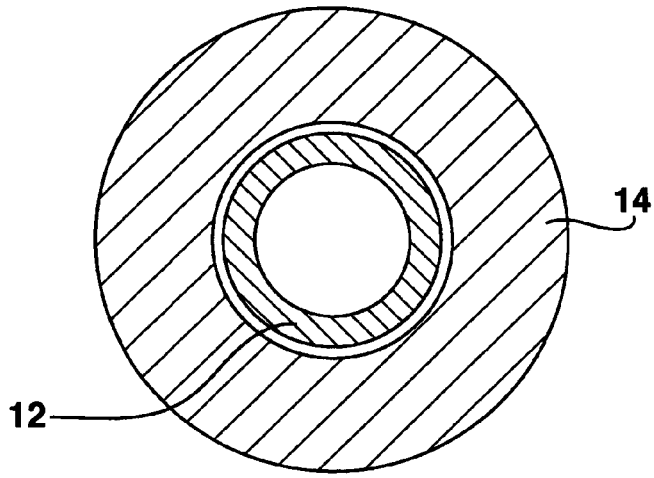
FIG. 2 is an enlarged cross-sectional view taken along the line 2—2 in FIG. 1.

An exercise device 10 according to the present invention is shown in FIG. 1. The invention 10 includes an elongate length of resilient tubing 12. In a preferred embodiment, the tubing 12 is constructed of latex or rubber. A tubular section 14 of rubberized foam has an axial bore therethrough sized to receive the tubing 12, as shown in FIG. 2. Two other tubular sections 16 and 18, similar in construction to tubular section 14, are provided with one being positioned on the tubing 12 on either side of tubular section 14, as shown in FIG. 1. The tubular sections 14, 16 and 18 are used to provide padding when the resilient tubing is positioned across or around a user.

A strap handle 20 is positioned adjacent one free end of the tubing 12, and a second strap handle 22 is similarly provided at the second free end of tubing 12. The strap handles 20 and 22 are mounted to the tubing 12 with a connector 24.

Figure 3:
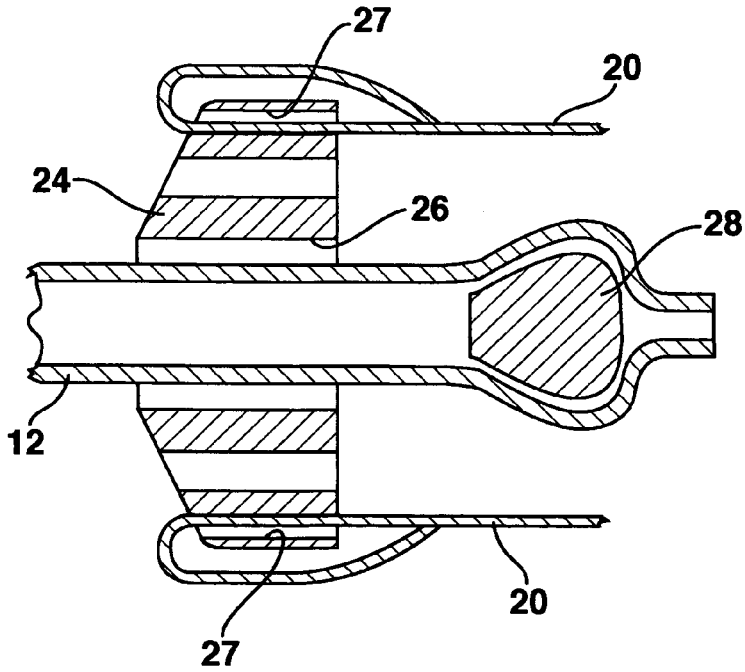
FIG. 3 is a cross-sectional view taken across a connector shown in FIG. 1 with portions broken away.

The connector 24 is provided with a central opening 26, as shown in FIG. 3, through which the tubing 12 extends. A plug 28 is inserted in the free end of tubing 12. The plug 28 has a diameter larger than the diameter of the opening 26 thereby preventing tube 12 from slipping through opening 26.

The free ends of strap handle 20 extend through openings 27 provided at opposite ends of connector 24, as shown in FIG. 3. Each end is looped back on itself and sewn to the body of strap 20. In this manner, strap handle 20 is secured to connector 24 with a loop opening 21 to be grasped by a user. In a similar manner, second strap handle 22 is secured to a connector 24, as shown in FIG. 1, with a loop 23 to be grasped by a user.

A support strap 30 is constructed of a single strap sewn together at one end 32 to form a main loop 34. The strap is further sewn together at 36 to form a second loop 38. The size of loop 38 is selected to fit around the tubular section 14.

The present invention can be used in several ways. For example, the strap handle 22 can be secured to a hook on a wall and the strap handle 20 can be formed into a larger loop by running tubing 12 through the loop 21 formed in strap handle 20. The larger loop can then be positioned around a shoulder of the user and stretching exercises commenced working against the resilient force of tubing 12.

Another configuration would be to hook support strap 30 onto a hook on a wall, for example, and then grasp handles 20 and 22 and pull against the resilient force provided by tubing 12.

The oversized tubular sections 14, 16 and 18 are used for padding on pressure points when the tubing 12 is positioned across a user.

The device is very versatile and can be used to conduct many different exercises of the arms and legs.

Figure 4:
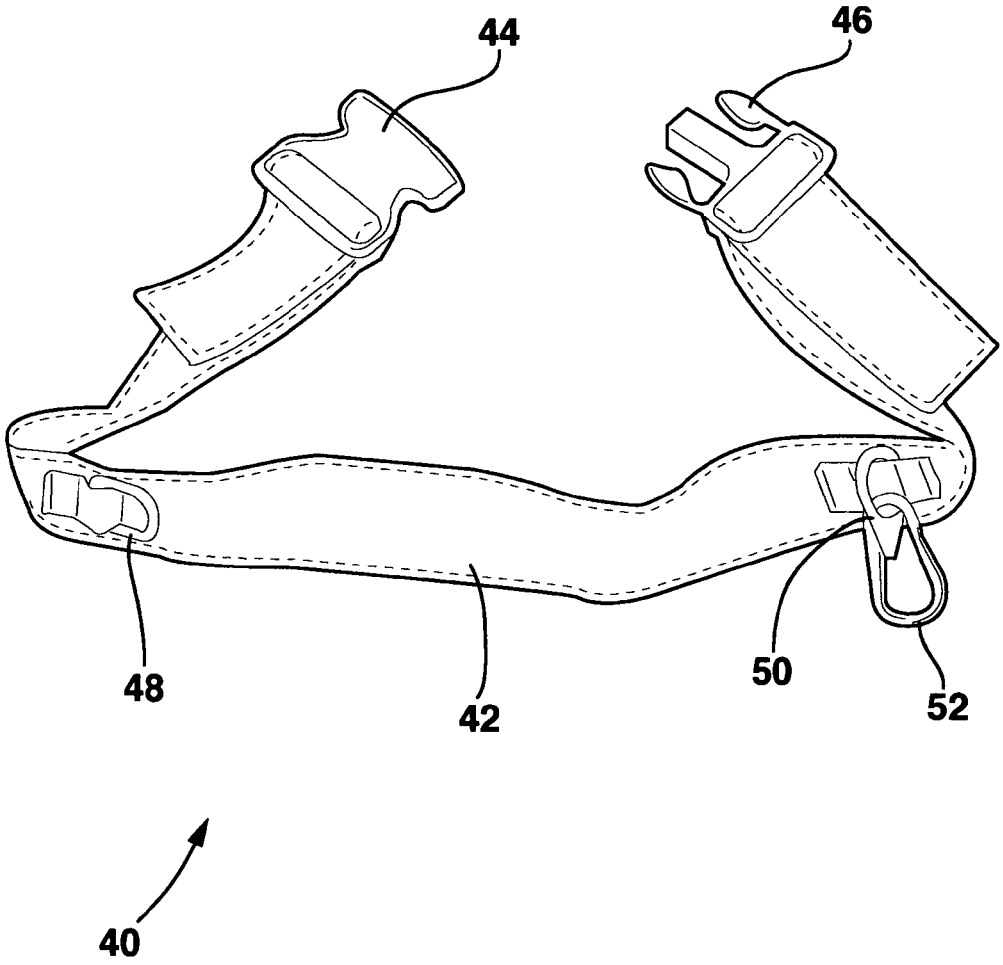
FIG. 4 is a perspective view of a waist belt used with the invention shown in FIG. 1.
Figure 5:
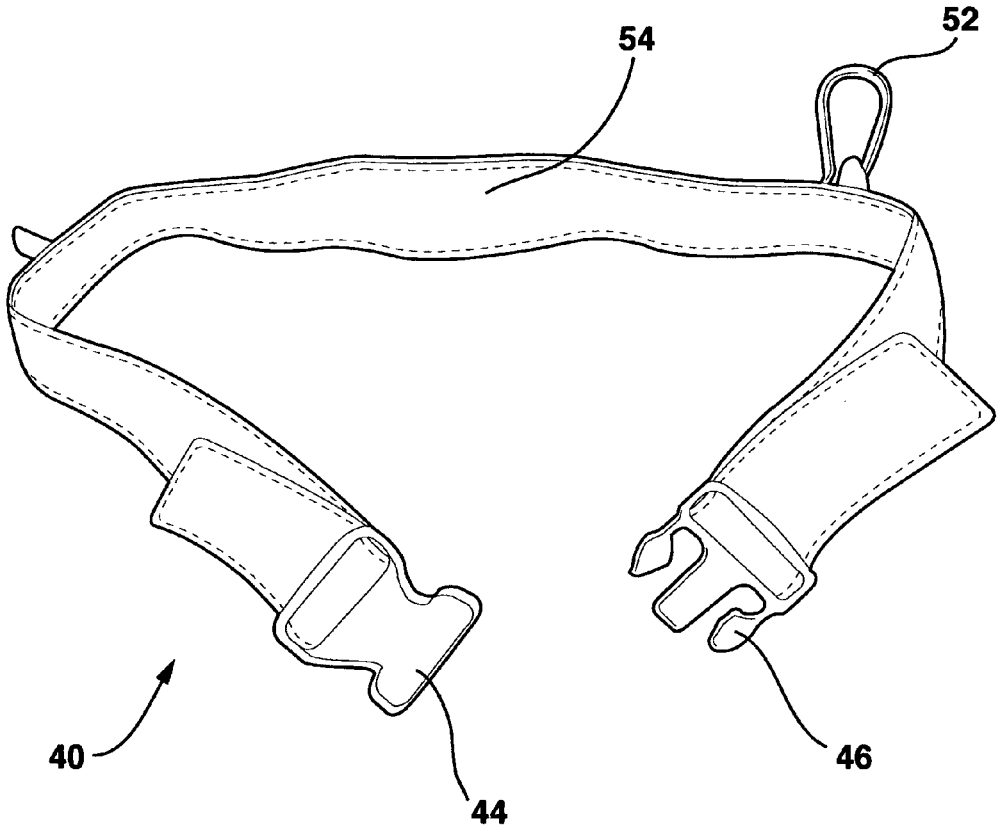
FIG. 5 is a second perspective view of the waist belt used with the invention shown in FIG. 1.

An exercise belt 40, as shown in FIGS. 4 and 5, can also be used with the present invention. The belt 40 includes a main body portion 42. A female buckle portion 44 is conventionally mounted at one free end of the body portion 42. A mating male buckle portion 46 is mounted at the other free end of the main body portion 42. The female buckle and male buckle can be buckled together to buckle the belt onto a user's waist.

On one side of the main body portion, a pair of "D"-rings 48 and 50 are mounted to the main body portion as with a sewn-on strap. A karabiner 52 is also provided which can be used to connect a handle 20 or 22 of the exercise device 10 to a selected "D"-ring 48 or 50.

As shown in FIG. 5, a non-slip material 54 is sewn on the reverse side of the main body portion 42, opposite the "D"-rings 48 and 50. The side with the non-slip material is positioned against the user when the belt is buckled onto the user.

In using the exercise device 10 with the belt 40, a user uses the karabiner 52 to attach either of the handles 20 or 22 to a selected "D"-ring. The strap handle not used with the karabiner 52 is then mounted to a hook or other device on a wall, for example. Exercises can be performed stretching against the resilient force provided by tubing 12. For example, a user may walk away from the wall where the exercise device 10 is connected against the resilient force of tubing 12 and then walk toward the wall releasing the tension. This walking back and forth can be repeated until the exercise is completed.

While the fundamental novel features of the invention have been shown and described, it should be understood that various substitutions, modifications, and variations may be made by those skilled in the art, without departing from the spirit or scope of the invention. Accordingly, all such modifications or variations are included in the scope of the invention as defined by the following claims:

We claim:

1. An exercise device comprising:

a length of resilient tubing having a first free end and a second free end;

a strap handle connected to the first fee end;

a strap handle connected to the second free end;

a first tubular section constructed of rubberized foam and having an inner diameter sized to slidably receive the resilient tubing;

the resilient tubing threaded through the first tubular section with the first tubular section positioned approximately midway between the first and second free ends;

a separate second tubular section, constructed of rubberized foam, slidably receiving the resilient tubing and positioned between the first free end and the first tubular section, the second tubular section further positioned in spaced apart relation with the first tubular section;

a separate third tubular section, constructed of rubberized foam, slidably receiving the resilient tubing and positioned between the second free end and the first tubular section, the first tubular section further positioned in spaced apart relation with the third tubular section;

a waist belt including a buckle means for buckling ends of the belt together;

a "D"-ring secured to the belt on an outward side of the belt;

a karabiner for connecting a strap handle to the "D"-ring; and a non-slip means attached to an inward side of the belt for preventing the belt from slipping when the belt is buckled onto a user.

2. The exercise device according to claim 1 further including a strap loop connected to the first tubular section.

* * * * *